US005373902A

United States Patent [19]

Lindblom

[11] Patent Number: 5,373,902

[45] Date of Patent: Dec. 20, 1994

[54] TILTABLE HOOD ASSEMBLY FOR AN EARTH WORKING MACHINE

[75] Inventor: Victor E. Lindblom, Brooklyn Center, Minn.

[73] Assignee: Caterpillar Paving Products Inc., Minneapolis, Minn.

[21] Appl. No.: 113,467

[22] Filed: Aug. 30, 1993

[51] Int. Cl.[5] ..... A01B 17/00; A01B 33/16

[52] U.S. Cl. ..... 172/112; 172/508; 172/72; 404/90; 37/429

[58] Field of Search ..... 172/112, 114, 508, 72, 172/497, 515; 404/90; 37/429, 223

[56] References Cited

U.S. PATENT DOCUMENTS

| | | | |
|---|---|---|---|
| 3,147,577 | 9/1964 | McCellan et al. | 172/112 |
| 3,661,213 | 5/1972 | Taylor | 172/112 |
| 3,746,101 | 7/1973 | Takata | 172/112 |
| 3,995,570 | 12/1976 | van der Lely | 172/112 |
| 4,458,763 | 7/1984 | Rao et al. | 172/112 |
| 4,664,201 | 5/1987 | Pegovard | 172/112 |
| 4,669,549 | 6/1987 | Sanpei et al. | 172/112 |
| 4,786,111 | 11/1988 | Yargici | 404/90 |
| 5,287,933 | 2/1994 | Lindblom | 172/112 |

FOREIGN PATENT DOCUMENTS

| | | | |
|---|---|---|---|
| 2803893 | 8/1978 | Germany | 172/112 |
| 240358 | 3/1989 | U.S.S.R. | 172/112 |

*Primary Examiner*—Randolph A. Reese
*Assistant Examiner*—Robert E. Pezzuto
*Attorney, Agent, or Firm*—Robert A. McFall

[57] ABSTRACT

A hood assembly includes a hood member and an adjustable length stabilizing link. The stabilizing link is movable between a first position at which the link maintains a bottom surface of the hood member in a substantially parallel relationship with a ground, or soil, surface and a second position at which the link tilts, or rotates, the hood member and thereby moves the bottom surface of the hood member to a nonparallel orientation with the ground surface. When in the tilted position, a portion of the bottom surface of the hood member is spaced from the ground surface at a distance sufficient to permit access for the repair or service of elements normally protectively enclosed by the hood member.

3 Claims, 3 Drawing Sheets

TILTABLE HOOD ASSEMBLY FOR AN EARTH WORKING MACHINE

TECHNICAL FIELD

This invention relates generally to a machine for stabilization, repairing, reconditioning, or taking-up of road or like surfaces, and more particularly to an assembly for stabilizing the movement of, or selectively tilting, a protective hood member on such machines.

BACKGROUND ART

Soil stabilizing and conditioning, and road reclaiming, machines having a horizontally disposed rotary cutter for working soil or roadway materials, are well known in the art. A machine of this type is described in U.S. Pat. No. 3,746,101, issued Jul. 17, 1973 to Harry H. Takata, and later assigned to the assignee of the present invention. Such machines typically have a protective hood member covering a rotary cutter and forming an open bottom mixing chamber for pulverizing materials excavated by the cutter. The hood member may further provide a support for nozzles or other fixtures by which additives are delivered to the mixing chamber and blended with the excavated material.

An improved hood support arrangement is described in copending U.S. application Ser. No. 07/829013, filed Oct. 22, 1991 by the inventor of the present invention and assigned to the assignee of the present invention. The improved hood support arrangement includes a pair of springs, attached to the machine frame, which cooperate to maintain the lateral, i.e., side-to-side, orientation of the hood member and support a portion of the weight of the hood member during ground engaging operation of the machine. Importantly, the improved hood support arrangement described in the referenced application also has a fixed length stabilizing link pivotally connected between the machine frame and the protective hood assembly to prevent fore-and-aft pitching of the hood member during raising, lowering, travel with the hood raised, and during cutting operations.

The machine elements enclosed by the hood member, such as the rotor and cutting tools, periodically require repair or replacement. Heretofore, opening a rear gate on the hood member provided only limited access to the rotor and cutting tools. Consequently, operators often drove the rear wheels of the machine up onto a mound and positioned the service area over a hole, or depression, in the ground to provide sufficient working room. Such difficulties in accessing the rotor and cutting tools are undesirable because they increase the time and cost of providing necessary maintenance, replacement, and repair services.

The present invention is directed to overcoming the problems set forth above. It is desirable to have a hood assembly for a soil stabilizing or road reclaiming machine that is maintained in a desired protective orientation during normal operation and movement of the machine, but which may be easily moved, by rotation or tilting, to a non-protective position for carrying out service or repair operations. Furthermore, it is desirable to have such a hood assembly that does not require separate elements for stabilizing the hood during normal operation and tilting the hood for servicing or repairing machine elements protected by the hood.

DISCLOSURE OF THE INVENTION

In accordance with one aspect of the present invention, a hood assembly for an earth working machine includes a hood member that forms an open bottom mixing chamber about a rotor. The hood member has a bottom surface that extends substantially completely about the hood member and is movable between a first position at which the bottom surface is in contact with a ground surface, a second position at which the the bottom surface is spaced from and in parallel relationship with the ground surface, and a third position at which the bottom surface is disposed in a divergent relationship with respect to the ground surface. The hood assembly also includes a stabilizing link that is pivotally interconnected between a frame of the machine and the hood member. The stabilizing link is movable between a first position at which the bottom surface of the hood member is maintained in a substantially parallel relationship with the ground surface in response to the hood member being positioned at, or moved between, the first and second positions of the hood member, and a second position at which the stabilizing link maintains the bottom surface at the third position of the hood member.

BEST MODE FOR CARRYING OUT THE INVENTION

Figure 1:
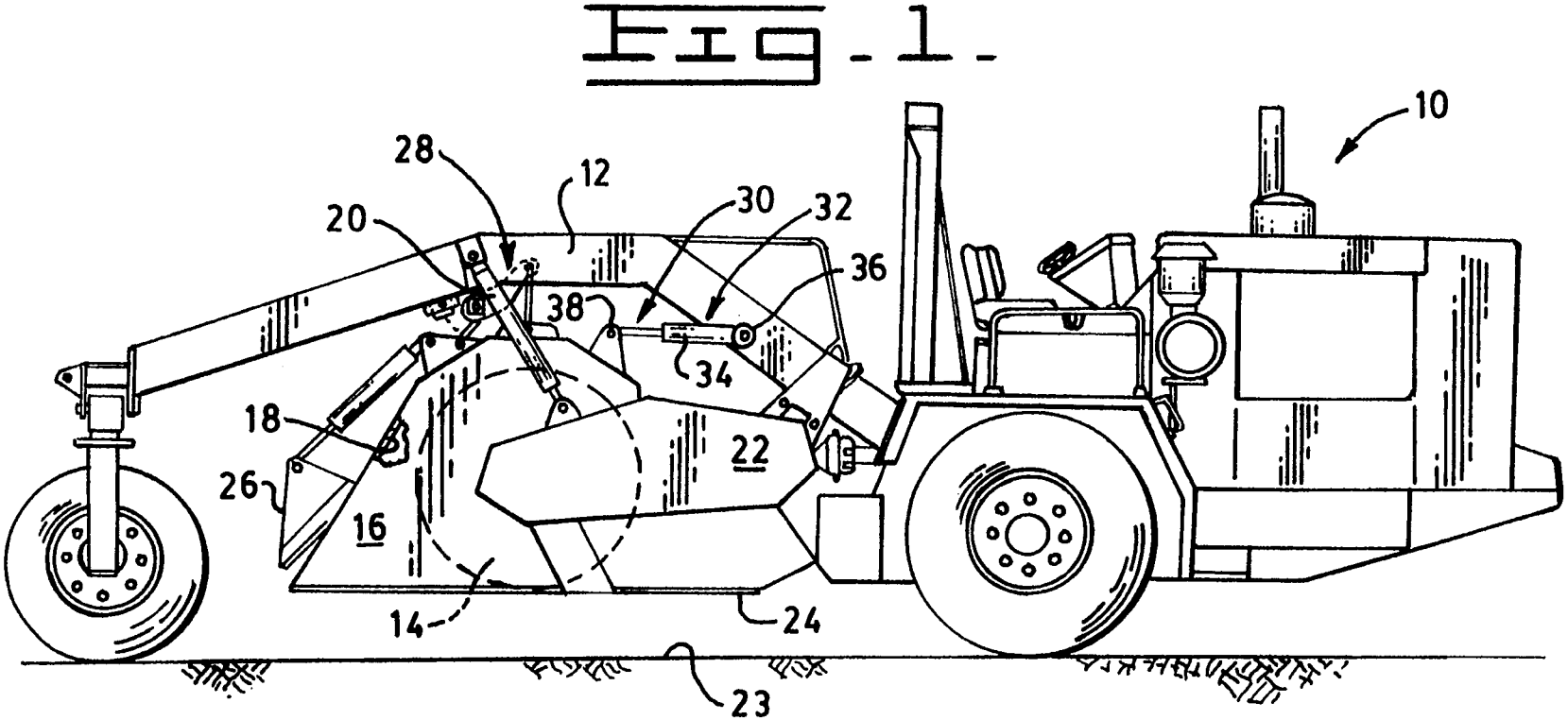
FIG. 1 is a side view of an earth working machine embodying the present invention, with the hood in a raised position.

An earth working machine 10, such as a soil stabilizer or a road reclaimer as shown in FIG. 1, typically has a frame 12, a horizontally disposed and vertically adjustable rotor 14 having ground engaging tools mounted thereon, and a hood member 16 that forms an open bottom mixing chamber 18 about the rotor 14.

A pair of hydraulic lift cylinders 20, disposed on opposed sides of the hood member 16, connect a pair of similarly disposed rotor drive cases 22 to the frame 12 and controllably position the rotor 14 vertically with respect to a ground surface 23 supporting the machine 10. Hence, the depth of ground penetration of the ground engaging tools mounted on the rotor is controlled by retraction or extension of the hydraulic cylinders 20. Typically, the hood member 16 is provided with a wear resistant surface or skid on at least a portion of a bottom, or ground contacting, surface 24 that extends around the lower peripheral portion of the hood member.

In order to form an effective enclosure about the rotor 14 when excavating or mixing materials, it is desirable that the bottom surface 24 of the hood member 16 be at a first position at which the bottom surface is in substantial contact with the ground surface 23. The hood member 16 is disposed in the above described first position in FIG. 2, and in phantom outline in FIG. 3.

To avoid excessive wear on the bottom surface 24 when the hood member 16 is at the first position, it is desirable that a portion of the weight of the hood member 16 be supported by a hood support assembly 28. The hood support assembly 28 is carried on the frame 12 and is adjustably connected, as described in the above referenced copending application, to the hood member 16.

The hood member 16 is moveable to a second, or raised, position, shown in FIG. 1, in response to retraction of the hydraulic lift cylinders 20. It is desirable, when the machine is moving with the hood member 16 in the raised position, that the bottom surface 24 of the hood member be maintained in a substantially parallel relationship with the ground surface 23.

In the preferred embodiment of the present invention, a hood assembly 30 includes the hood member 16 and a stabilizing link 32. The stabilizing link 32 is desirably oriented along the longitudinal axis of the earth working machine 10 and is pivotably connected at one end to the frame 12 and at the other end to the hood member 16. The stabilizing link 32 forms, in cooperation with the frame 12, the rotor drive cases 22, and a portion of the hood member 16, links of a structure that maintains the bottom surface 24 of the hood member 16 in a parallel relationship with the ground 23 during normal cutting or travel operations. Furthermore, the stabilizing link 32, when maintained in a float mode at a biased position, as described below, controllably restricts fore and aft pitching motions of the hood member 16.

Figure 2:
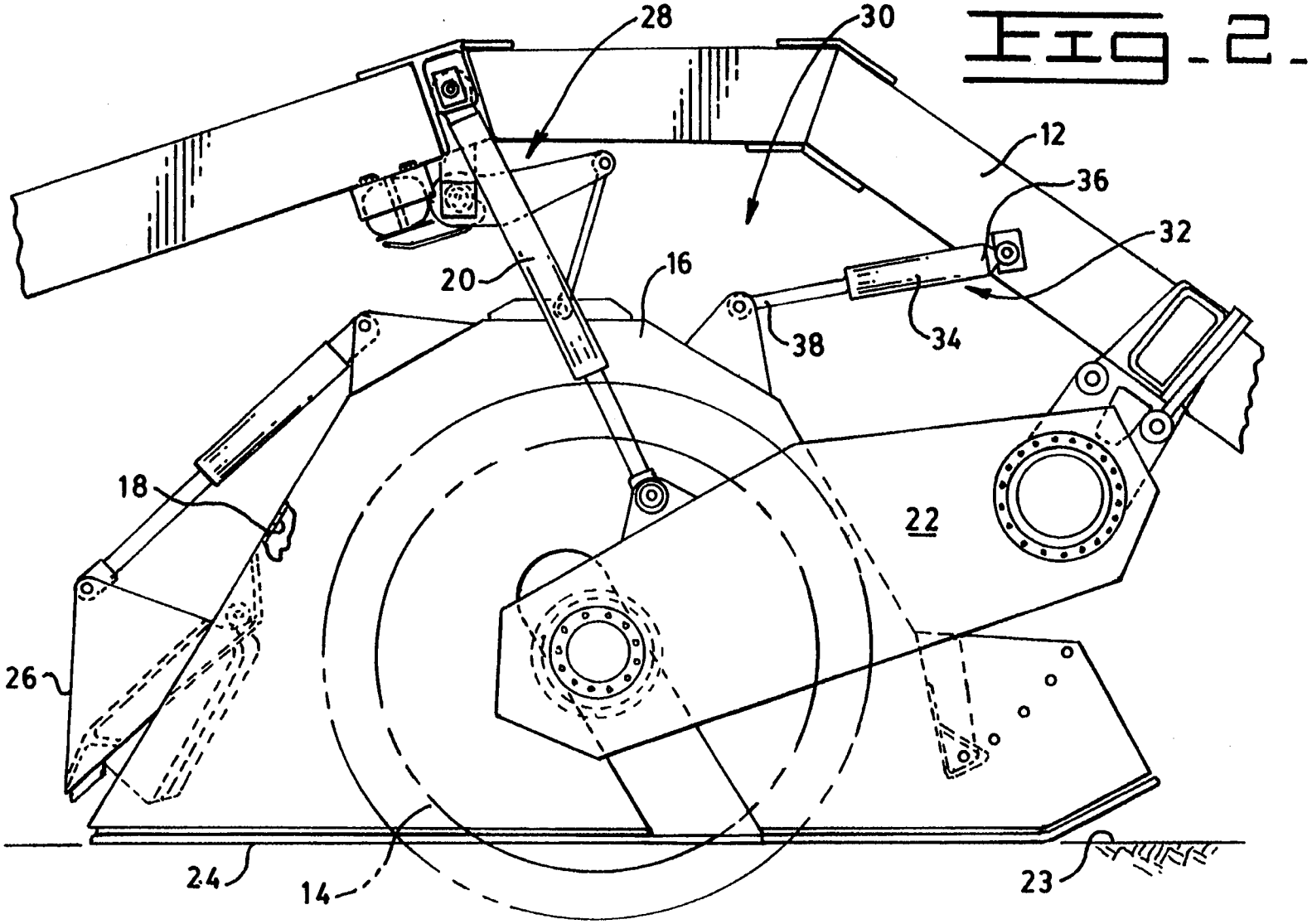
FIG. 2 is a side view of the hood assembly embodying the present invention, with the hood in a lowered, or normal operational, position.
Figure 3:
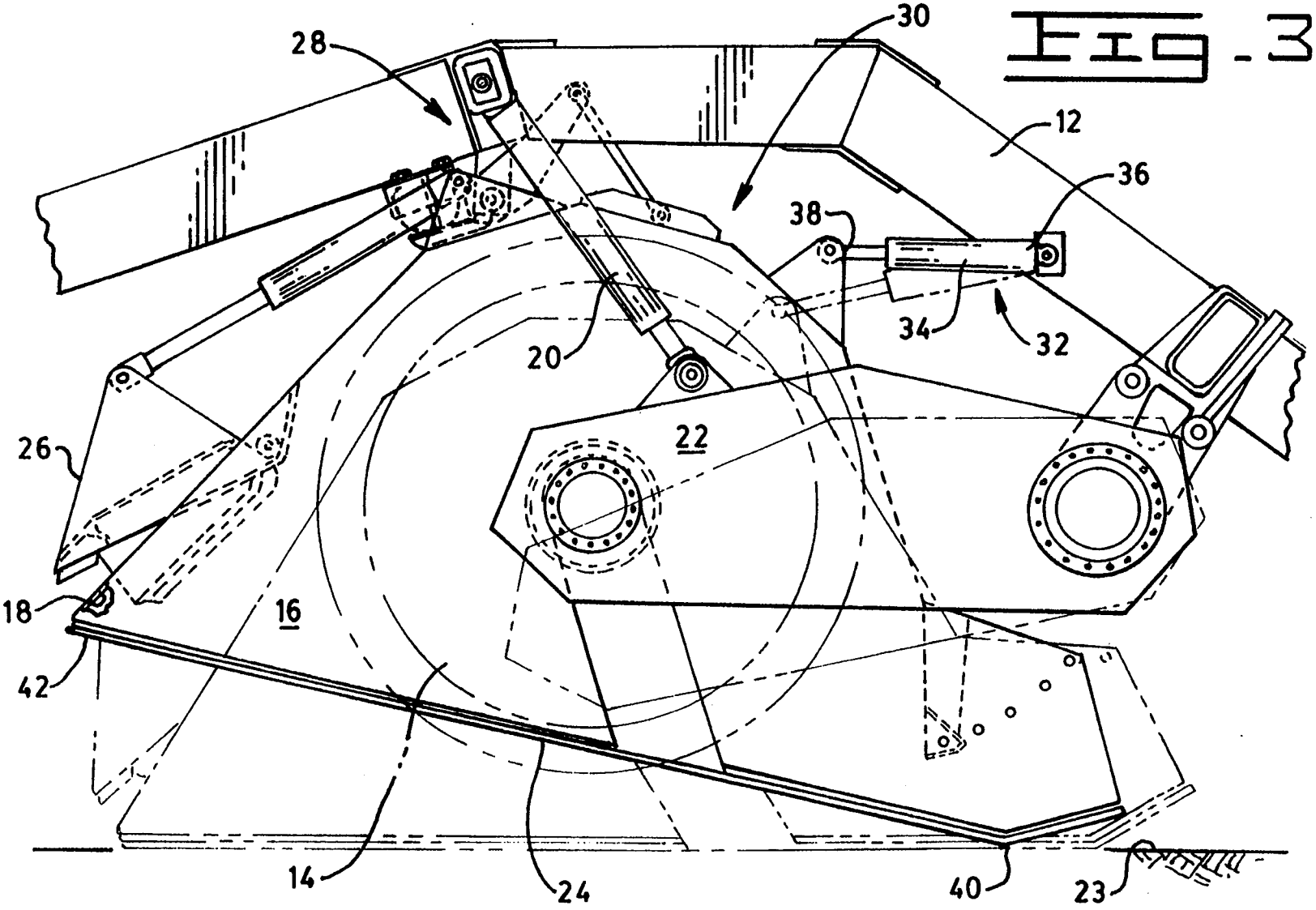
FIG. 3 is a side view of the hood assembly embodying the present invention, with the hood in a tilted, or service, position.

In carrying out the present invention it is necessary that the stabilizing link 32 have a selectively variable length, such as a hydraulic cylinder 34, as shown in FIGS. 1-3. Desirably, the hydraulic cylinder 34 is a double acting cylinder having a head, or fixed, end 36 pivotably attached to the frame 12, and an extendable, or movable, rod end 38 pivotably connected to the hood member 16. It is also desirable that the piston disposed within the cylinder have a greater cross-sectional area on the head end side than on the rod end side. Movement of the rod end 38 is controlled by a 3-way valve having extend and retract positions that selectively direct a flow of pressurized fluid to a corresponding side of the internal piston, and a central float position at which both sides of the piston are in fluid communication.

The adjustable length stabilizing link 32 serves two important functions. In carrying out the first function, the stabilizing link 32 is extended to a first position, as shown in FIGS. 1 and 2, and in phantom lines in Fig.3. After extension to the first position, the control valve is moved to the float position thereby maintaining the stabilizing link 32 at the extended position during all operations of the machine, including excavation, mixing, and travel. Furthermore, because of the differential in cross-sectional area of cylinder 34, a biasing force is provided against retraction of the rod end 38. This feature not only restricts the fore and aft pitching of the hood member but also maintains a downward pressure on a rear gate 26 that strikes-off the mixed material exiting the rear of the hood member 6.

Thus, after movement to the first position, the stabilizing link 32 is allowed to controllably float in length to maintain the bottom surface 24 of he hood member 16 in a substantially parallel relationship with the ground surface 23 independently of the elevational position of the hood member. Going over bumps or uneven terrain will cause the hood member 16 to pitch slightly, thereby reducing drag, rather than forcing the entire hood member 16 to rise parallel with the ground. After the event causing the tilting motion has passed, the stabilizing link 32 returns the hood member 16 to the previous, substantially parallel, relationship with respect to the ground surface 23.

In carrying out the second function, the stabilizing link 32 is retracted to a second position at which the stabilizing link rotates, or tilts, the hood member 16 to a third position, as shown in Fig. 3. When disposed in the third position, the bottom surface 24 of the hood member 16 is disposed in a divergent relationship with respect to the ground surface 23. Preferably, the hood member 16 is raised to the second position, illustrated in FIG. 1, by retraction of the lift cylinders 20 prior to retracting the movable end 38 of the stabilizing link and tilting the hood member. When rotated to the above described third position, a first portion 40 of the bottom surface 24 rests on the ground surface 23, and a second portion 42 of the bottom surface is spaced a significant distance from the ground surface. The space between the second portion 42 of the bottom surface 24 and the ground 23 provides an opening through which the rotor, cutting tools mounted on the rotor, or other machine components disposed inside the hood member, may be the serviced, repaired, or replaced.

INDUSTRIAL APPLICABILITY

The hood assembly 30 embodying the present invention is particularly useful for stabilizing the motion, i.e., limiting fore and aft pitching, of the hood member 16 of an earth working machine 10 during operation and travel. Machines of this type are conventionally used to stabilize soil, reclaim roadways, pulverize excavated material, and mix additive materials with soil or reclaimed roadway materials.

The hood assembly 30 embodying the present invention also permits the raising a portion of the bottom surface substantially above the ground surface. The opening thus formed, provides convenient access to machine elements enclosed by the hood member 16 for purposes of service or repair. The access opening is formed by tilting the hood member 16, in response to moving a movable end of the stabilizing link. In the tilted position, a portion of the hood member is spaced from the ground surface 23 at a distance sufficient to provide unencumbered access to the rotor, cutting tools and other machine components protectively enclosed by the hood member. Thus, the variable length stabilizing link 32, not only controls motion of the hood member during operation of the machine but also, when required for service or repair purposes, selectively moves the hood to a position that provides access to components enclosed by the hood member.

Other aspects, objects and advantages of this invention can be obtained from a study of the drawing, the disclosure, and the appended claims.

What is claimed is:

1. A hood assembly for an earth working machine having a frame and a rotor rotatably mounted on said frame, said hood assembly comprising:

a hood member defining an open bottom mixing chamber about said rotor and having a bottom surface extending substantially completely about a peripheral portion of the hood member, and being movable between a first position at which said bottom surface is in substantial contact with a ground surface supporting said earth working machine, a second position at which said bottom surface is spaced from said ground surface in substantially parallel relationship therewith, and a third position at which said bottom surface is disposed in a divergent relationship with respect to said ground surface; and, a stabilizing link having a first end pivotably attached to said frame and a second end pivotably connected to said hood member, said stabilizing link being movable between a first position at which said stabilizing link maintains the bottom surface of said hood member in a substantially parallel relationship with said ground surface in response to said hood member being positioned at, and during movement between, said first and second positions of the hood member, and a second position at which said stabilizing link maintains said bottom surface of said hood member at said third position.

2. A hood assembly, as set forth in claim 1, wherein the third position of said bottom surface is a position at which a first portion of the bottom surface is in contact with said ground surface and a second portion of the bottom surface is spaced from said ground surface at a distance sufficient to provide access to said rotor.

3. A hood assembly, as set forth in claim 1, wherein said stabilizing link is a hydraulic cylinder having a fixed end pivotably attached to said frame and a movable end pivotably connected to said hood member.

* * * * *